US005417295A

United States Patent [19]

Rao et al.

[11] Patent Number: 5,417,295

[45] Date of Patent: May 23, 1995

[54] METHOD AND SYSTEM FOR THE EARLY DETECTION OF THE JAMMING OF A CORE SAMPLING DEVICE IN AN EARTH BOREHOLE, AND FOR TAKING REMEDIAL ACTION RESPONSIVE THERETO

[75] Inventors: M. Vikram Rao; Bobby T. Wilson; Laban M. Marsh, all of Houston, Tex.

[73] Assignee: Sperry Sun Drilling Services, Inc., Houston, Tex.

[21] Appl. No.: 78,702

[22] Filed: Jun. 16, 1993

[51] Int. Cl.[6] ..... E21B 47/09

[52] U.S. Cl. ..... 175/40; 175/46; 175/58

[58] Field of Search ..... 175/24, 27, 38, 40, 175/46, 58

[56] References Cited

U.S. PATENT DOCUMENTS 4,499,563 2/1985 Jürgens ..... 175/48 X 4,601,354 7/1986 Campbell et al. ..... 175/46

4,638,872 1/1987 Park et al. ..... 175/46

4,735,269 4/1988 Park et al. ..... 175/46

*Primary Examiner*—William P. Neuder

*Attorney, Agent, or Firm*—Browning, Bushman, Anderson & Brookhart

[57] ABSTRACT

A drill string having a core sampling device at its lower end is suspended in an earth borehole by a rotary drilling rig at the earth's surface. Drilling fluid pulsations are monitored in the drilling fluid standpipe to generate characteristic signatures of normal coring operations and a precursor, abnormal, signature when the core sampling device first begins to jam, before catastrophic jamming has occurred. Responsive to the abnormal signature, remedial action is commenced, such as reducing WOB, RPM, or terminating the coring operation. The system is also used to determine that an activatable downhole tool has one or more of its parts moved from a first position to a second position.

34 Claims, 6 Drawing Sheets

METHOD AND SYSTEM FOR THE EARLY DETECTION OF THE JAMMING OF A CORE SAMPLING DEVICE IN AN EARTH BOREHOLE, AND FOR TAKING REMEDIAL ACTION RESPONSIVE THERETO

BACKGROUND OF THE INVENTION

1. Field of the Invention

The present invention relates, generally, to a method and system for detecting the early stages involved with the jamming of a core sampling device, before catastrophic jamming has occurred, and more particularly, to a method and system for taking remedial action, based upon such early detection, to prevent such catastrophic jamming of the device.

2. Description of the Background

Conventional devices for obtaining core samples from an earth borehole comprise a tubular housing attached on one end to a special bit commonly known as a core head, and at the other end to a drill string extending to the earth's surface. The tubular housing in turn comprises an inner and an outer barrel with a space between. During normal drilling the drilling fluid flows through the interior of the inner barrel. When a core sample is required, the flow passageway in the inner barrel is blocked, often by dropping a ball from the earth's surface, thus diverting the flow into the space between the inner and outer barrel and down through the bit. The absence of flow in the inner barrel allows the earth formation to enter and fill the barrel, which is then subsequently recovered as a core.

One disadvantage of conventional methods is that in many situations jamming of the core in the inner barrel can occur. This causes the drill string weight to be transferred substantially away from the outer barrel to the core and to the inner barrel, causing fracture of the core and cessation of core acquisition. In this event either penetration of the formation ceases or drilling does in fact continue, resulting in milling of the formation by the corehead, rendering that portion of the formation permanently unrecoverable since the milled material simply gets pumped to the surface with other rock cuttings. This situation is particularly undesirable in formations where coring as a means of evaluation is imperative due to the inherent limitations of wireline logging in those types of formations. This is discussed in the paper by Bradburn and Cheatham entitled "Improved Core Recovery in Laminated Sand and Shale Sequences", Journal of Petroleum Technology, December 1988.

The prior art, in addressing the problem of jamming, has had only limited success. For example, in U.S. Pat. No. 4,492,275 to Frank L. Campbell et al., a core jamming indication is sought by noting rotation of the inner barrel which is normally stationary relative to the outer barrel. However, by the time such rotation has occurred, the core is almost certainly broken off. Furthermore, the method relies on use of expensive Measurement While Drilling (MWD) equipment to signal this event to the surface.

This type of system will, in most cases, result in catastrophic jamming of the core sampling device, or in one of the other equally troublesome problems above discussed, before the surface personnel are aware of the problem.

As another example of the prior art, in PCT Application No. WO92/02707 filed by Arno et al., a downhole core sampling is disclosed in which jamming of a core causes the inner barrel to be pressed against the outer barrel, cutting off the flow passage between the barrels, thus causing a significant increase in the pressure of the drilling fluid detectable at the earth's surface. However, the mechanical means required to produce the flow passage blockage is triggered by significant loading on the core, at which point core fracture has in all probability occurred.

Thus, each of these two prior art attempts to detect jamming involve the same problems, that of (1) requiring modification of the core sampling devices themselves, and (2) resulting all too often in catastrophic jamming of the device or fracturing of the core sample.

It is therefore the primary object of the present invention to provide a new and improved method and system for the early detection of the jamming of the core sampling device, before major problems develop, thus enabling timely remedial action to be taken.

It is another object of the invention to provide a new and improved method and system for determining the movement, or other activation of parts in downhole tools.

SUMMARY OF THE INVENTION

The objects of the invention are accomplished, generally, by method and system which provide precise, high resolution monitoring and filtering of pressure pulsations in the drilling fluid in identifying precursor events prior to catastrophic jamming. When such precursor events are detected, a change in a controllable parameter such as rpm or weight on bit is made to avoid full fledged jamming. If jamming persists, as indicated by the nature of the pressure profiles, a decision may be made to pull out of the hole to prevent milling of rock. In a preferred embodiment of the invention, pump noise is filtered out and pressure variations from downhole are detected to a resolution of 10 psi or better in order to observe the fine features that comprise the anticipatory signature of jamming events.

As an additional feature of the invention, a method and system is provided to enable surface operation to know precisely when downhole tools are activated by observing changes in the drilling fluid passageways.

BRIEF DESCRIPTION OF THE DRAWINGS

These and other objects, features and advantages of the present invention will be readily understood from a reading of the following specification, making reference to the drawings in which.

DETAILED DESCRIPTION OF THE INVENTION

Figure 1:
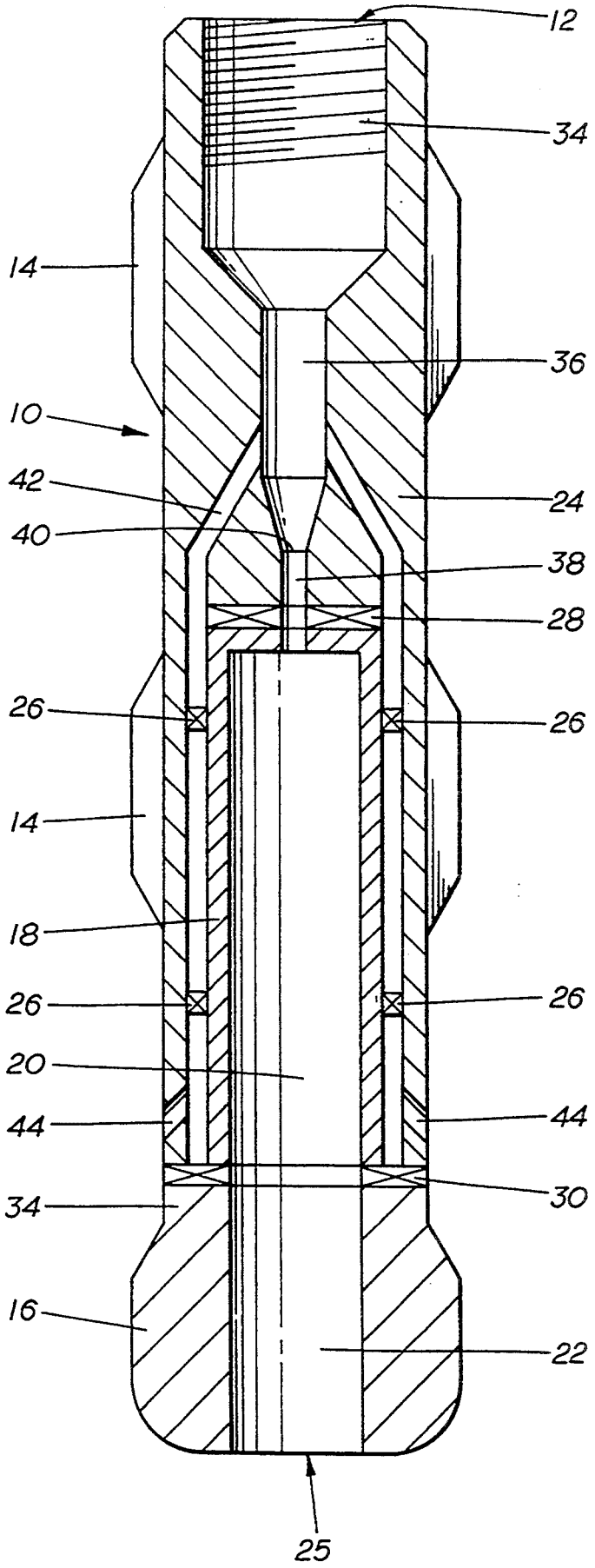
FIG. 1 is an elevated, schematic view of a conventional core sampling device prior to its being used to obtain a core sample.

Referring now to FIG. 1 there is illustrated, schematically, a conventional core sampling device 10 having a first female, or box end 12 threaded internally to receive a pin end of a drill collar (not illustrated). The device 10 has a plurality of stabilizers 14 between its ends and a coring head 16 at its lower end.

An inner core barrel 18 has its interior chamber 20 aligned with the interior chamber 22 of the coring head 16. The inner core barrel 18 is rotatably mounted within the outer core barrel 24 by a plurality of beating surfaces 26 on the sides of the inner core barrel 18. A bearing surface 28 separates the top of the inner core barrel 18 from the outer core barrel 24. A bearing surface 30 separates the bottom of the inner core barrel 18 from the shank 32 of the coring head 16.

A drilling fluid passage commencing with the chamber 34 funnels down through a chamber 36 to an even greater reduced diameter chamber 38 having a ball seat 40. The chamber 38 completes the drilling fluid passage into the chamber 20 within the inner core barrel 18.

A second drilling fluid passage 42 is connected into the chamber 36, above the ball seat 40, providing a drilling fluid passage between the inner core barrel 18 and the outer core barrel 24, and exits into the annulus 23 through the ports 44.

Figure 2:
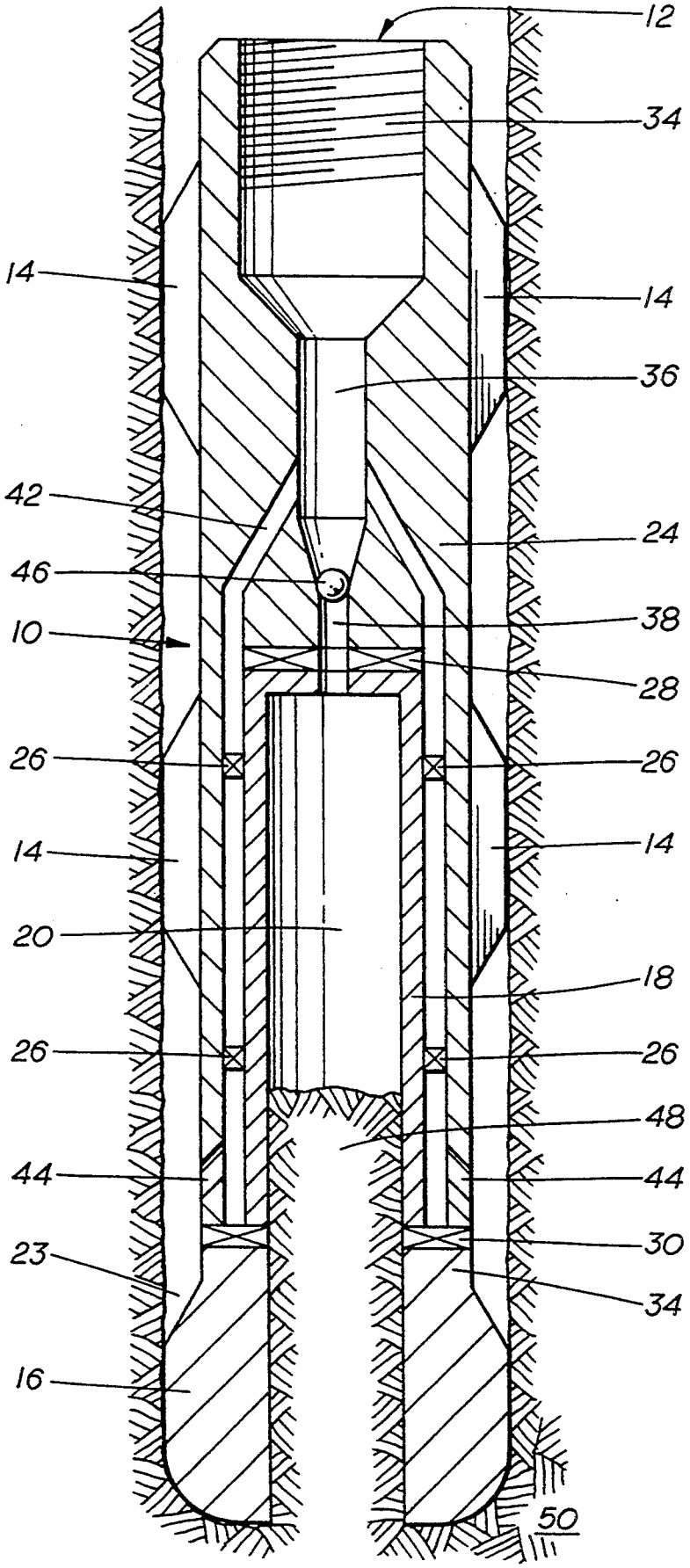
FIG. 2 is an elevated, schematic view of the device of FIG. 1 during the core sampling operation within an earth borehole.

Referring now to FIG. 2, the apparatus according to FIG. 1 is illustrated, again schematically, as having a ball 46 dropped from the earth's surface into the ball seat 40, to close off the passage 38. A core sample 48 is illustrated as partially filling the chamber 20, having been drilled up by the coring head 16 from the earth formation 50.

In the operation of the conventional coring sampling apparatus 10 illustrated in FIGS. 1 and 2, the drilling fluid pumped from the earth's surface passes, sequentially, through the chambers 34, 36, 38 and 20, and exits through the chamber 22 of the coring head 16 to the borehole annulus 23 illustrated in FIG. 2.

When it is designed to obtain a core sample, the ball 46 is dropped from the earth's surface to seal off the passage 38, thus causing all of the drilling fluid to pass through the passage 42 and the exit ports 44 into the annulus 23. The cessation of the drilling fluid flow out of the exit port 25 leading from the chamber 22 allows the core sample 48 to progressively enter the chamber 20, all in a manner well known in the art.

The particular form of the core sampling device utilized with the present invention is not important, except as will be explained in more detail hereafter. It is well known that core sampling devices, regardless of their structure, or their mode of operation, share one characteristic; the tendency to jam. They usually have means (not illustrated) within the chamber 20 to "catch" the core, and are thus labeled as a core catcher. The core sample 48 all too often will jam, typically in a mode which will cause the sample to discontinue moving up in the chamber 20. This, in turn, causes the weight of the drill string to rest on the bottom of the core, shifting the weight of the drill string to the inner core barrel 18. More often than not, this action destroys the inner workings of the core sampling device 10.

Figure 3:
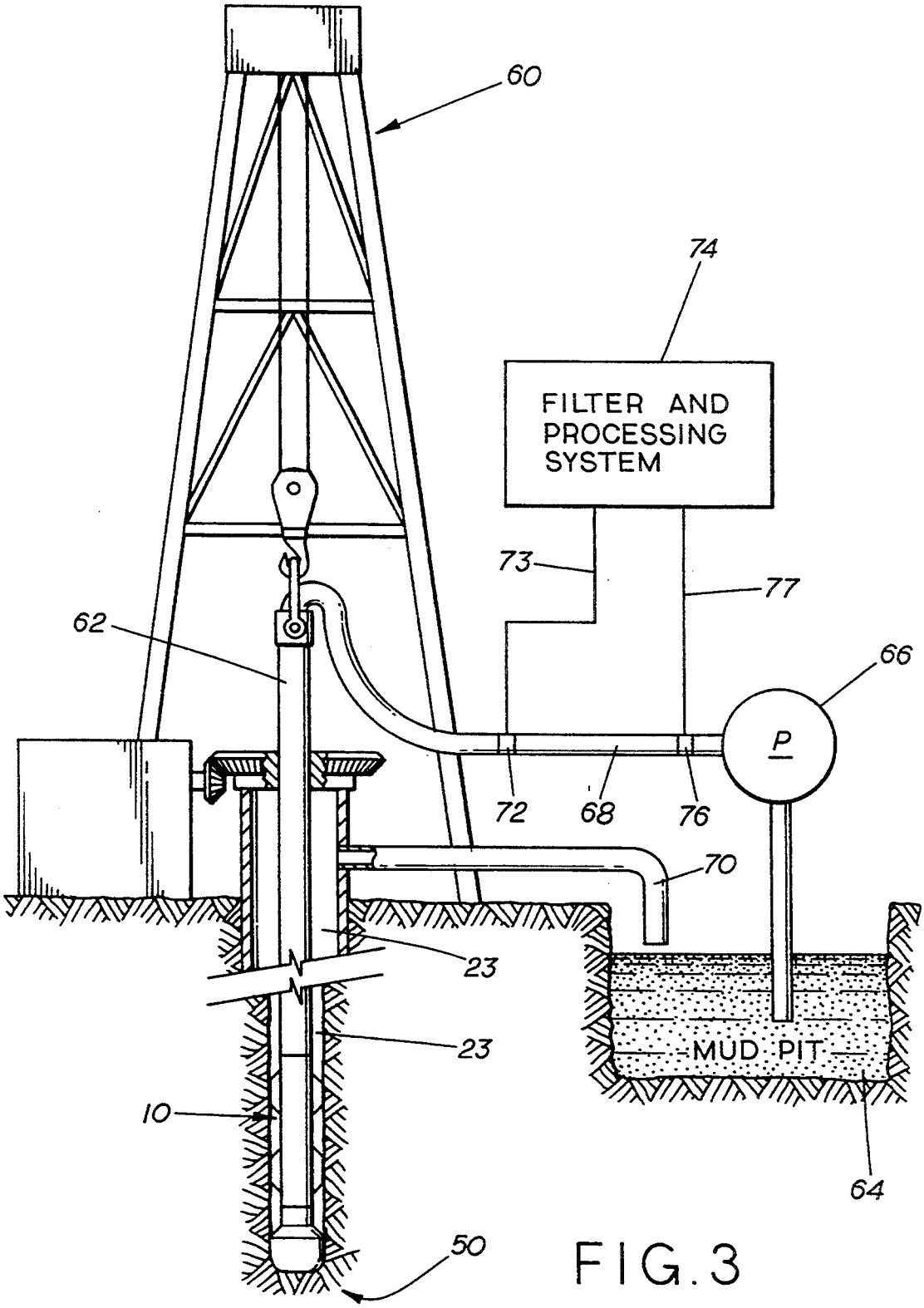
FIG. 3 is an elevated view of a drilling rig from which is suspended a drill string in an earth borehole.

Referring now to FIG. 3, there is illustrated, schematically, a drilling rig 60 having a string 62 of drill pipe and drill collars which is suspended in the earth formation 50, and which has a core sampling device at its lower end for drilling and collecting core samples. The drilling fluid is picked up from the mud pit 64 by pump 66, which may be of the piston reciprocating type, and circulated through the stand pipe 68, down through the drill string 62, out through the exit port of the core sampling device 10, and back to the earth's surface in the annulus 23 between the drill string 62 and the wall of the well bore. Upon reaching the surface, the drilling fluid (the "mud") is discharged through the line 70 back into the mud pit where cuttings of rock or other well debris are allowed to settle out before the mud is recirculated. A piezoelectric pressure transducer 72 is placed in the standpipe 68, the output of such transducer being connected to the filtering and processing system 74 explained in more detail hereinafter. A pump stroke counter transducer 76 is also placed in the standpipe 68, the output of such transducer 76 also being connected into the system 74.

Figure 4:
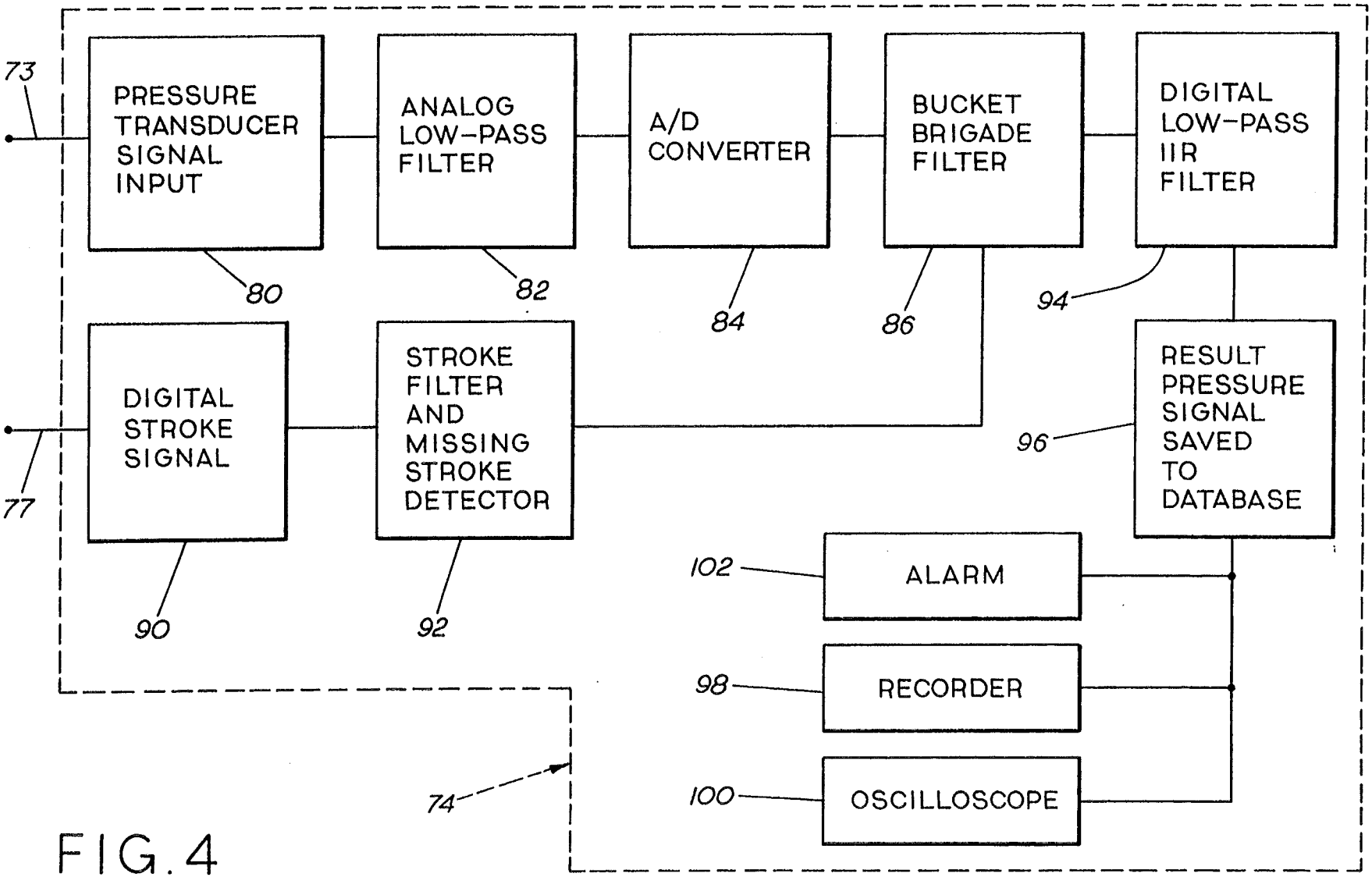
FIG. 4 is a flow diagram of the signal processing circuitry used in accordance with the present invention to provide early detection of jamming in the core sampling device suspended at the lower end of the drill string of FIG. 3.

Referring now to FIG. 4, the filter and processing system 74 of FIG. 3 is illustrated and described in greater detail. The line 77 from the first transducer 72 drives the pressure transducer signal input circuitry 80 which with the transducer 72 converts the 0–5000 psi pressure input experienced by the transducer 72 to a 4–20 ma output, which is then converted to a 1–5 V analog signal. The output of the circuit 80 drives an analog low-pass filter circuit 82. In order to ensure the input pressure signal is band limited and the sample procedure meets the Nyquist criterion, the anti-aliasing analog low pass filter 82 is used prior to the A/D conversion. It is implemented using a two-pole, 1.25 dB ripple Chebyshev filter with a cutoff frequency at 50 Hz.

The output of the filter circuit 82 drives an A/D converter 84. To achieve desired accuracy of the pressure signal reading, a 16 bit A/D converter is used in the system to convert analog input to digital for later digital signal processing. The sampling frequency used is 250 Hz.

The A/D converter 84 drives one input of a Bucket Brigade filter 86, which can be fabricated in accord with U.S. Pat. No. 4,730,281 to Paul F. Rodney et al., assigned to Baroid Technology, Inc. the assignee of the present invention. In order to remove the analog pump noise, the Bucket Brigade filter 86 is used to remove the pump noise at the particular frequency which varies with pump rate. The Bucket Brigade filter 86 generates a reference waveform that is the closest approximation of the pumps's noise output. This reference is subtracted from the input pressure signal to generate a noise free output. It is noteworthy that the delay line used in the Bucket Brigade filter 86 is only adjusted for duration following stroke event. The convents of the delay line are not modified (rubber-band fitting) to fit the new duration following stroke. Instead, the delay line is caused to fit the new duration by successive averaging. If a missing stroke is detected, since the missing stroke detector has appended a copy of the wave for a missing stroke, the functionality of the filter is not affected.

The line 77 from the secured pressure transducer 76 drives the input of the digital stroke signal circuit 90, which causes the pump stroke signals to be interpreted as either an o or a 5 v signal coming out of the circuit 90. The output of the circuit 90 drives a stroke filter and missing stroke detector 92. The stroke filter is responsible for stroke pattern recognition. It has the capability of determining mud pump on/off status and stroke rates. The stability of the pump rates are closely monitored and missing strokes are detected and corrected according to previous stroke intervals' averaging values. The output of the circuit 92 drives a second input of the Bucket Brigade filter 86.

The output of the Bucket Brigade filter 86 drives the input of a digital low-pass IIR filter 94. Since the Bucket Brigade filter has removed the analog mud pump noise, only the other (non-mud pump signals) exit the Bucket Brigade filter 86. In this application, since only the signal components with very low frequencies are of interest, a single pole, unity gain infinite impulse response filter 94 is used. It's cutoff frequency is set at 6.25 Hz.

The output of the filter 94 is coupled into the circuit 96 which contains the signal representative of the condition of the core sampling device such as device 10 of FIGS. 1 and 2. The representative signal, oftentimes a precursor to catastrophic jamming of the core sampling device, is stored in a digital recorder 98 and is also displayed visually for the surface operator, for example, on the oscilloscope 100.

In the operation of the system hereinafter described, it is important to differentiate between the repetitive pressure variations due to routine pumping and circulation of the drilling fluid, and the non-repetitive pressure events due to, and representative of drilling and coring. The box 96 of FIG. 4 will preferably include a notebook computer, 386SX or faster, with 4 megabytes RAM memory, and 40–60 megabytes hard drive memory. The software used with the system should preferably be written specifically for the coring operation to allow the screen 100 display of standpipe pressure to be adjustable to allow a visual examination of the absolute standpipe pressure within a very narrow range, for example, 100 psi. Although the other sensors, and their connected lines are not illustrated, the screen 100 display should preferably include rotation of the drill string (RPM), weight on the core head (WOB) and depth of the drill string in the earth borehole.

Unlike the historical methods for detecting jamming of the core sampling device, such as monitoring WOB, RPM or huge increases in standpipe pressure, usually indicating catastrophic jamming, the present invention provides a time versus pressure signature or profile of a normal (non-jamming) coring operation and a time versus pressure signature or profile of a precursor event anticipatory of catastrophic jamming.

Once the coring operation has commenced, for example, by dropping the ball 46 into the seat 40 in FIGS. 1 and 2, the profile as viewed on a display 100 will demonstrate an initial sharp rise in pressure, indicative of the closure of the passage 38.

Figure 5:
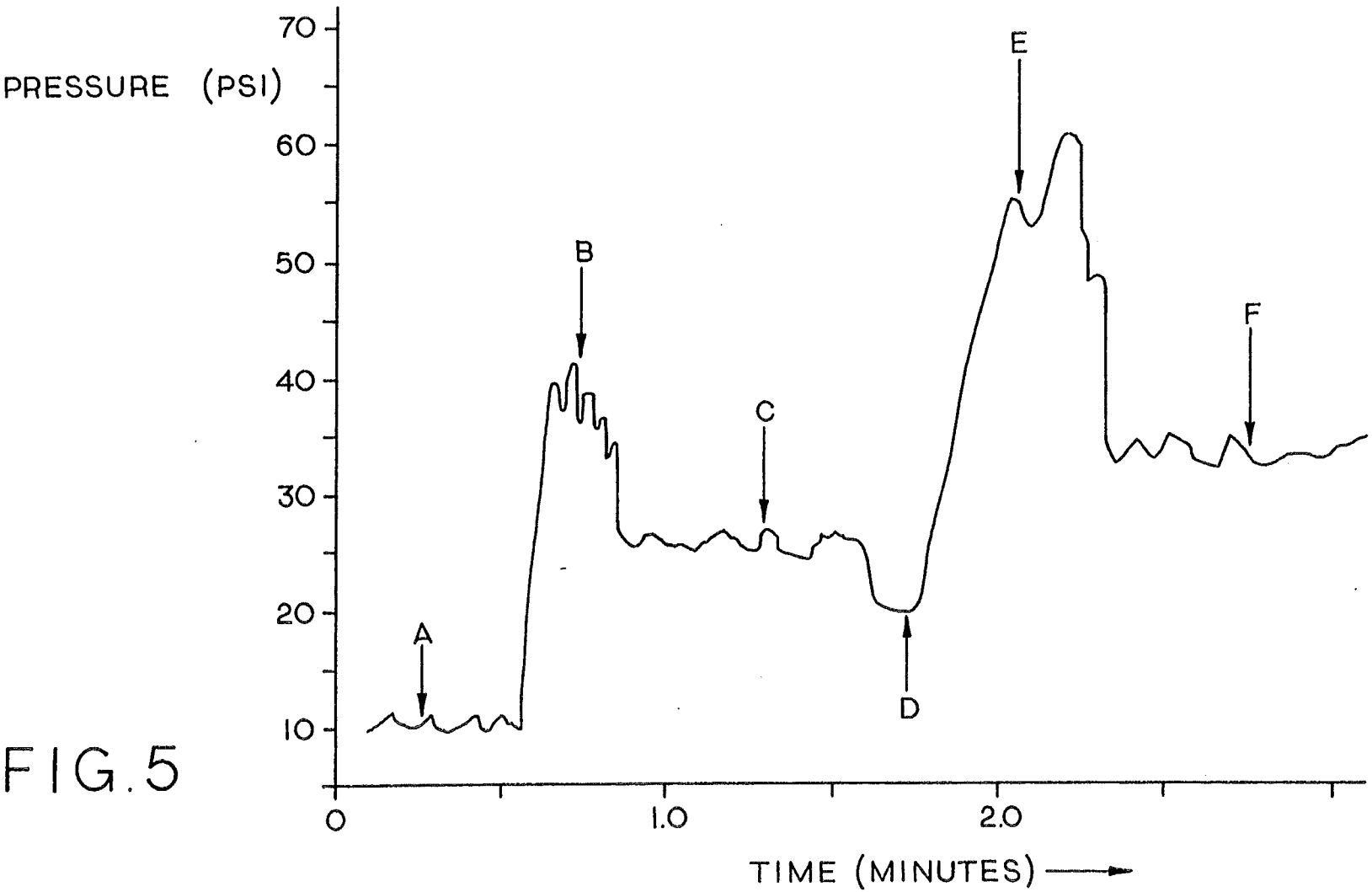
FIG. 5 is a representative curve of standpipe pressure versus time used to monitor a downhole tool in accord with the present invention.

FIG. 5 illustrates graphically a plot of the standpipe pressure version time in the coring operation. The curve segment A is indicative of the ball 46 not yet having dropped into the seat 40. The segment B reflects the ball having been seated into the seat 40, with its concomitant rise in the standpipe pressure, and then the leveling off of the pressure during the normal coring operation as indicated by the segment C of the pressure curve. The segment C curve will develop its characteristic shape after coring has begun, and after the core head has fully shaped its profile upon the face of the well bore. The amplitude of the curve segment C will be a function of the cumulative pressure drops within the drill string, through the I.D. and across the face of the core head. The standpipe pressure will have a reading on-bottom minus off-bottom equivalent to the pressure drop across the core head. During normal coring, the shape of the curve is generally horizontal, with very few and small variations in pressure (+/−10 psi). The absolute pressure reading of the curve will be a function of the design and makeup of the drill string including the core barrel and core head, the shape of the well bore, the rate of flow of the drilling fluid, the rheological characteristics of the drilling fluid, and the lithology or properties of the formation being cored.

In a common form of jamming, the jammed core barrel prevents further entry of the core into the inner tube. Weight on Bit is gradually transferred from the core head to the core stump as the jammed core prevents further penetration. As the WOB is transferred to the core stump, the core head becomes less compressed against the face of the well bore. This "drilling off" by the core head causes a drop in standpipe pressure, because of less resistance to flow of drilling fluid across the face of the core head. This drop in pressure becomes the first stage of the characteristic curve associated with the abnormal pressure variation. This precursor drop in pressure is illustrated in sequent D of the curve illustrated in FIG. 5.

At some point, the WOB which has been transferred to the core stump becomes too great. The core stump will fail under the weight, or the jam will release, allowing the drill string and coring assembly to quickly and forcibly drop back into full contact with the well bore. The collapse of the core stump, and/or the momentary burial of the core head into the well bore generates an accumulation of formation particles of various sizes in the throat of the core head between the lower end of the inner barrel and I.D. gage of the core head. The accumulation of material described above is forced by the drilling fluid to plug the primary fluid courses. This plugging causes an immediate rise in standpipe pressure. This increase in pressure can be as great as 1000 p.s.i. in very hard formations, to as little as 50 p.s.i. in very soft, unconsolidated formations. The sharp rise in pressure, indicating the plugging of the fluid course, is shown in segment E of the curve of FIG. 5.

At some level of increased pressure, the blockage in the fluid courses of the core head is overcome, and a rush of drilling fluid removes some or all of the blockage. This results in an immediate and significant reduction in standpipe pressure, as illustrated by segment F of the curve of FIG. 5.

If the jam has been relieved, the standpipe pressure profile will return to approximately the original level. Partial plugging after coring has resumed will be demonstrated by an elevated "normal" curve. Thus, if the segment F returns to the same level as segment C, the plugging of the fluid course has been removed. If the segment F is elevated with respect to segment C (as illustrated in FIG. 5), this is indicative of partial plugging of the fluid courses.

The shape of the pressure curve will be primary determined by the compressive strength of the rock of the formation being cored. In formations such as unconsolidated sand, with a very low compressive strength, the variance of amplitude of the curve will be very small. The system according to the present invention is uniquely able to differentiate subtle abnormal pressure variations. The curve will also vary in amplitude and response to the potential jam depending upon the core head design. Core heads with face discharge ports will generate a curve different from those with conventional fluid courses. Core heads with polycrystalline diamond compact cutters, PDC, with a high stand-off between the bit face and the formation will have a much lower amplitude than thermally stable synthetic diamond cutters, or natural diamond models with little or no stand-off.

Time is of the essence in practicing the present invention. A precursor event, anticipator of catastrophic jamming can occur very rapidly, typically from thirty seconds to four minutes.

Because coring service technicians may be occupied with other duties during the coring operation, and miss the short duration, precursor signature such as segment D of FIG. 5, additional circuitry can be provided, using well-know artificial intelligence concepts, to sound the alarm 102 of FIG. 4 in the event of such a detected precursor event.

Once the abnormal event is detected, either by the visual display on the oscilloscope 100, or by the tinging of the alarm 102, or by whatever means, the drilling superintendent can take remedial action to prevent the further jamming of the coring device. The remedial action will typically take the form of altering a drilling parameter, such as varying the RPM or the Weight on Bit (WOB). If the same or similar abnormal signature continues despite the change in the one or more drilling parameters, the coring operation should be discontinued, and the drill string pulled out of the borehole. If desired, the jammed core sampling device can then be replaced and the coring operations resumed by running the drill string back into the borehole.

Figure 6:
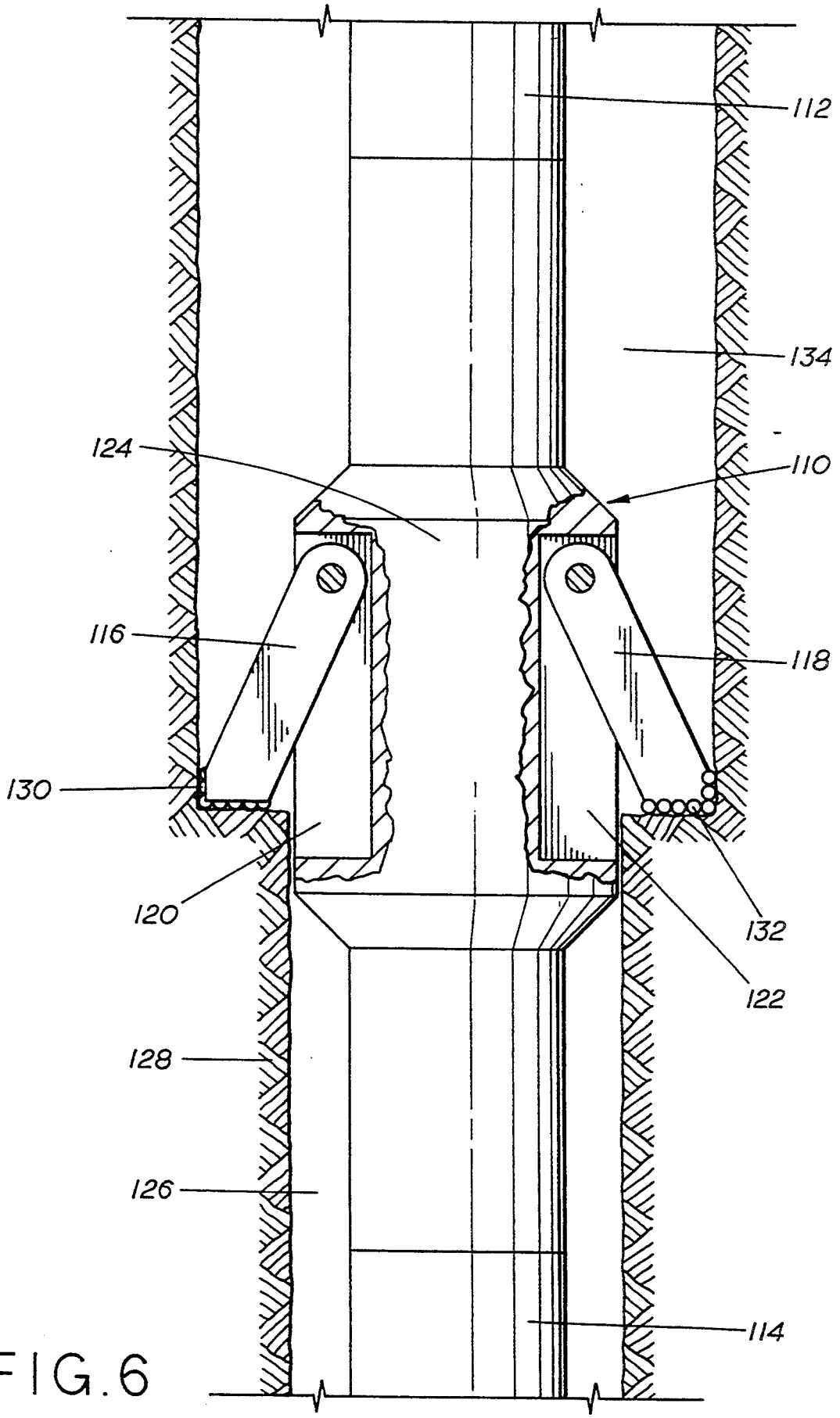
FIG. 6 is an elevated, schematic view of an alternative downhole tool whose activation is monitored in accord with the present invention.

Referring no to FIG. 6, there is illustrated, quite schematically, a well bore enlarging apparatus 110 in place within a drill string between a pair of drill collars 112 and 114. The hole enlarging apparatus 110 has threaded box ends in its upper and lower ends to receive the pin ends of drill collars 112 and 114, respectively.

The hole enlarging apparatus 110 has two or more retractable cutting assemblies 116 and 118 which reside in the retracted position, within the two or more cavities 120 and 122, the cavities being within the enlarged section 124 of the apparatus 110. It should be appreciated that the apparatus illustrated in FIG. 6 is highly schematic in nature and is intended only to demonstrate the present invention, which is used to monitor the outward movement of the plurality of arms 116 and 118. If desired, the apparatus 110 can be manufactured in accord with the teaching of U.S. Pat. No. 4,589,504, especially as is illustrated in FIG. 2 of that patent, the patent being assigned to Baroid Technology, Inc., the assignee of the present application.

Suffice it to say at this point that the apparatus 110 is run into the well bore 126 in an earth formation 128 until such time as it is desired to enlarge the borehole at some specific depth of interest. At such depth of interest, the plurality of arms 116 and 118 are expanded outwardly and use the cutters 130 and 132 to enlarge the diameter of the borehole, for example, as is illustrated with the borehole 134 having a greater diameter than the borehole 126.

In the operation of the present invention with respect to monitoring the movement of the arms 116 and 118 of FIG. 6, the drill string having the apparatus 110 therein is first ran into the earth borehole 126. When the apparatus 110 is activated, either by a change of drilling fluid pressure or by manipulation of the drill string, the arms 116 and 118 begin to expand outwardly. This movement changes the hydraulics of the drilling fluid, and will generate a characteristic signatures in the pressure wave as measured by the transducers 72 and 76, in conjunction with the system 74 of FIGS. 3 and 4, in essentially the same manner as was described herein with respect to generating a precursor signal indicative of the imminent jamming of a core sampling devices.

The invention can also be used with any downhole tool having one or more parts having multiple positions, such as adjustable stabilizers, hole openers, underreamers and the like.

What is claimed is

1. A method for determining that a core sampling device is in the early stages of jamming, comprising:

filtering out the effects of repetitive pressure pulsations in the drilling fluid standpipe of a rotary drilling rig having a string of drill pipe and a core sampling device controlled by said drilling rig;

monitoring the pressure pulsations of the drilling fluid in the said standpipe representative of the coring operation of said core sampling device prior to its being jammed; and detecting a change in said monitored pressure pulsations caused by variations in the flow path of the drilling fluid as such drilling fluid exits the core sampling device into the annulus surrounding the string of drill pipe, said change being indicative of the early stages of jamming of said core sampling device.

2. The method according to claim 1, including in addition thereto, the step of altering a drilling parameter, in response to said detected change, to limit the extent of jamming of said core sampling device.

3. The method according to claim 2, wherein said drilling parameter is the RPM of the drill string.

4. The method according to claim 2, wherein said drilling parameter is the weight on bit.

5. The method according to claim 2, wherein the step of altering a drilling parameter comprises the termination of the drilling operation.

6. A method for determining that a core sampling device is in the early stages of jamming, comprising:

monitoring the pressure pulsations of the drilling fluid in the standpipe of a rotary drilling rig representative of the coring operation of said core sampling device prior to its being jammed; and detecting a change in said monitored pressure pulsations caused by variations in the flow path of the drilling fluid as such drilling fluid exits the core sampling device into the annulus surrounding the string of drill pipe, said change being indicative of the early stages of jamming of said core sampling device.

7. The method according to claim 6, including in addition thereto, the step of altering a drilling parameter, in response to said detected change, to limit the extent of jamming of said core sampling device.

8. The method according to claim 7, wherein said drilling parameter is the RPM of the drill string.

9. The method according to claim 7, wherein said drilling parameter is the weight on bit.

10. The method according to claim 7, wherein the step of altering a drilling parameter comprises the termination of the drilling operation.

11. A method for determining the activation of a downhole tool suspended in a drill string in an earth borehole from a rotary drill rig, comprising:

filtering out the effects of repetitive pressure pulsations in the drilling fluid standpipe of said rotary drilling rig;

monitoring the pressure pulsations of the drilling fluid in the said standpipe representative of the state of said downhole tool prior to its activation; and detecting a change in said monitored pressure pulsations caused by variations in the flow path of the drilling fluid as such drilling fluid passes through or near said downhole tool, said change being indicative of the activation of said downhole tool.

12. The method according to claim 11, wherein said downhole tool is a hole opener.

13. The method according to claim 11, wherein said downhole tool is a core sampling device.

14. The method according to claim 11, wherein said downhole tool is an underreamer.

15. The method according to claim 11, wherein said downhole tool is an adjustable stabilizer.

16. A system for determining that a core sampling device is in the early stages of jamming, comprising:

means for filtering out the effects of repetitive pressure pulsations in the drilling fluid standpipe of a rotary drilling rig having a string of drill pipe and a core sampling device controlled by said drilling rig;

means for monitoring the pressure pulsations of the drilling fluid in the said standpipe representative of the coring operation of said core sampling device prior to its being jammed; and means for detecting a change in said monitored pressure pulsations caused by variations in the flow path of the drilling fluid as such drilling fluid exits the core sampling device into the annulus surrounding the string of drill pipe, said change being indicative of the early stages of jamming of said core sampling device.

17. The system according to claim 16, including in addition thereto, means for altering a drilling parameter, in response to said detected change, to limit the extent of jamming of said core sampling device.

18. The system according to claim 17, wherein said drilling parameter is the RPM of the drill string.

19. The system according to claim 17, wherein said drilling parameter is the weight on bit.

20. The system according to claim 17, wherein the means for altering a drilling parameter comprises means for terminating the drilling operation.

21. A system for determining that a core sampling device is in the early stages of jamming, comprising:

means for monitoring the pressure pulsations of the drilling fluid in the standpipe of a rotary drilling rig representative of the coring operation of said core sampling device prior to its being jammed; and means for detecting a change in said monitored pressure pulsations caused by variations in the flow path of the drilling fluid as such drilling fluid exits the core sampling device into the annulus surrounding the string of drill pipe, said change being indicative of the early stages of jamming of said core sampling device.

22. The system according to claim 21, including in addition thereto, means for altering a drilling parameter, in response to said detected change, to limit the extent of jamming of said core sampling device.

23. The system according to claim 22, wherein said drilling parameter is the RPM of the drill string.

24. The system according to claim 22, wherein said drilling parameter is the weight on bit.

25. The system according to claim 22, wherein the means for altering a drilling parameter comprises means for terminating the drilling operation.

26. A system for determining the activation of a downhole tool suspended in a drill string in an earth borehole from a rotary drilling rig, comprising:

means for filtering out the effects of repetitive pressure pulsations in the drilling fluid standpipe of said rotary drilling rig;

means for monitoring the pressure pulsations of the drilling fluid in the said standpipe representative of the state of said downhole tool prior to its activation; and means for detecting a change in said monitored pressure pulsations caused by variations in the flow path of the drilling fluid as such drilling fluid passes through or near said downhole tool, said change being indicative of the activation of said downhole tool.

27. The system according to claim 26, wherein said downhole tool is a hole opener.

28. The system according to claim 26, wherein said downhole tool is a core sampling device.

29. The system according to claim 26, wherein said downhole tool is an underreamer.

30. The system according to claim 26, wherein said downhole tool is an adjustable stabilizer.

31. A method for determining that a core sampling device is in the early stages of jamming, comprising:

monitoring the pressure pulsations of the drilling fluid in the standpipe of a rotary drilling rig to generate a characteristic signature representative of the coring operation of said core sampling device prior to its being jammed; and detecting a change in said signature caused by variations in the flow path of the drilling fluid as such drilling fluid exits the core sampling device into the annulus surrounding the string of drill pipe, said change being indicative of the early stages of jamming of said core sampling device.

32. A method for determining that a downhole tool having at least one part movable from a first position to a second position, has moved from said first position to said second position, comprising:

monitoring the pressure pulsations of the drilling fluid in the standpipe of a rotary drilling rig to generate a characteristic signature representative of said at least one part being in said first position; and detecting a change in said signature caused by variations in the flow path of the drilling fluid as such drilling fluid passes through or near said downhole tool, said change being indicative of said at least one part having moved to said second position.

33. A system for determining that a core sampling device is in the early stages of jamming, comprising:

means for monitoring the pressure pulsations of the drilling fluid in the standpipe of a rotary drilling rig to generate a characteristic signature representative of the coring operation of said core sampling device prior to its being jammed; and means for detecting a change in said signature caused by variations in the flow path of the drilling fluid as such drilling fluid exits the core sampling device into the annulus surrounding the string of drill pipe, said change being indicative of the early stages of jamming of said core sampling device.

34. A system for determining that a downhole tool having at lease one part movable from a first position to a second position, has moved from said first position to said second position, comprising:

means for monitoring the pressure pulsations of the drilling fluid in the standpipe of a rotary drilling rig to generate a characteristic signature representative of said at least one part being in said first position; and means for detecting a change in said signature caused by variations in the flow path of the drilling fluid as such drilling fluid passes through or near said downhole tool, said change being indicative of said at least one part having moved to said second position.

* * * * *